US012492886B2

(12) United States Patent
Pedicini et al.

(10) Patent No.: US 12,492,886 B2
(45) Date of Patent: Dec. 9, 2025

(54) NON-LETHAL PROJECTILE CONSTRUCTION AND LAUNCHER

(71) Applicant: NL Enterprises, LLC, Cheyenne, WY (US)

(72) Inventors: Christopher Pedicini, Brentwood, TN (US); Josh Pedicini, Nashville, TN (US)

(73) Assignee: NL Enterprises, Cheyenne, WY (US)

( * ) Notice: Subject to any disclaimer, the term of this patent is extended or adjusted under 35 U.S.C. 154(b) by 0 days.

(21) Appl. No.: 18/128,178

(22) Filed: Mar. 29, 2023

(65) Prior Publication Data

US 2023/0314112 A1 Oct. 5, 2023

Related U.S. Application Data

(62) Division of application No. 16/563,795, filed on Sep. 6, 2019, now abandoned.

(Continued)

(51) Int. Cl.
*F42B 12/36* (2006.01)
*F41H 13/00* (2006.01)

(Continued)

(52) U.S. Cl.
CPC ..... *F42B 12/50* (2013.01); *F41H 13/00* (2013.01); *F42B 12/36* (2013.01); *F42B 12/46* (2013.01);

(Continued)

(58) Field of Classification Search
CPC ..... F42B 12/36; F42B 12/40; F42B 12/46; F42B 12/50; F42B 12/66; F41H 13/00

(Continued)

(56) References Cited

U.S. PATENT DOCUMENTS 3,930,448 A * 1/1976 Barber ..... F42B 8/24 116/210
5,750,918 A * 5/1998 Mangolds ..... F42B 12/66 102/213

(Continued)

FOREIGN PATENT DOCUMENTS

WO WO-9515476 A1 * 6/1995 ..... F41H 13/00

OTHER PUBLICATIONS

Machine translation of WO-9515476-A1 (Year: 1995).*

*Primary Examiner* — James S Bergin
(74) *Attorney, Agent, or Firm* — Aidenbaum Schloff and Bloom PLLC; Jay Schloff

(57) ABSTRACT

A nonlethal projectile includes a debilitating material for immobilizing a target. The projectile is capable of self-separating or otherwise opening after launch by a launcher to release the debilitating material prior to impact with a target. The launcher is capable of initiating separation of the projectile. Opening may also be accomplished by a control circuit with a radio-frequency identification (RFID), where an RFID tag in the projectile causes the projectile to open at a user-specified distance from the launcher or by the force of launch on the projectile. A magazine may holds a plurality of projectiles and the various projectiles of the magazine may be configured to open at different distances and/or times after launch. The launcher may include a trigger and/or a safety switch to prevent the projectile from becoming armed until a certain parameter is met. The debilitating material may also be released through pores in the projectile.

1 Claim, 16 Drawing Sheets

Related U.S. Application Data

(60) Provisional application No. 62/828,395, filed on Apr. 2, 2019, provisional application No. 62/728,374, filed on Sep. 7, 2018.

(51) Int. Cl.

| | |
|---|---|
| ***F42B 12/46*** | (2006.01) |
| ***F42B 12/50*** | (2006.01) |
| *F41A 21/16* | (2006.01) |
| *F42C 9/14* | (2006.01) |
| *F42C 11/06* | (2006.01) |

(52) U.S. Cl.
CPC ..... *F41A 21/16* (2013.01); *F42C 9/147* (2013.01); *F42C 11/06* (2013.01)

(58) Field of Classification Search
USPC ..... 102/502, 512, 513
See application file for complete search history.

(56) References Cited

U.S. PATENT DOCUMENTS 7,861,698 B2 * 1/2011 Nordstog ..... F42B 12/36 124/16
8,056,481 B2 * 11/2011 Dindl ..... F42B 12/36 102/502

* cited by examiner

NON-LETHAL PROJECTILE CONSTRUCTION AND LAUNCHER

CROSS-REFERENCE TO RELATED APPLICATIONS

The present disclosure is a divisional application of pending U.S. Non-provisional application Ser. No. 16/563,795, filed on Sep. 6, 2019, the disclosure of which is incorporated by reference.

FIELD OF THE DISCLOSURE

The present disclosure relates to low velocity projectiles for use in non-lethal weapons or other launching mechanisms and more specifically, to those projectiles and launchers which use compressed gas or batteries for operation.

BACKGROUND OF THE DISCLOSURE

Non-lethal projectiles and non-lethal launching systems are commonly used by law enforcement for purposes of crowd control, such as quelling a riot or angry mob or to individually subdue a suspect. Increasingly, they may find usage as another means to augment self-defense in situations such as a home invasion, for example. The projectiles and systems (such as weapons that are capable of delivering such non-lethal projectiles) are designed to subdue a target subject or subjects for a time without causing permanent harm. Typically, such weapons systems require a projectile to burst on impact with the suspect and thus require accurate targeting and, in some cases, cause severe injury to a suspect. The most common means for such a device is a projectile that bursts on impact or a targeting device tethered by wires which delivers a high voltage shock thus immobilizing the suspect. All of these existing means suffer from a number of disadvantages outlined in more detail below.

The use of high voltage electric shock has been around for a number of years. While it is fairly effective at immobilizing a suspect, it suffers from the drawbacks that cardiac arrest in the target/suspect may result due to the voltage imparted into the suspect's body. Additionally, in the case of a suspect who is not in an open or unconstrained environment, such means requires accurate targeting to ensure that the electrodes contact the individual in order to deliver the electric shock. Furthermore, the longest effective range for such a device is less than 30 feet and more typically 10 or 15 feet. Additionally, the effectiveness of such weapons can be inhibited by clothing, coats or wet environments.

A second technique involves the use of a paintball that is filled with a capsicum or PAVA powder. While this eliminates or improves on the range issues of the electric shock techniques, it requires accurate targeting of the suspect. This is extremely difficult to do in short range as the ricochet of the powder off of a suspect can cause it to come back to the user. Furthermore, upon impact, the control of the powder release is not necessarily effective and can be one dimensional, meaning that it has difficulty stopping a suspect who is running away—as the cloud is left behind. Additionally, if the impact does not burst the projectile, the intended effect is not achieved.

Another approach is to provide for a projectile, the rupture or separation of which is caused by components that are powered by a battery or batteries that is/are internal to the projectile. However, in that batteries are inherently respectively large and heavy when compared to a projectile, and therefore limit the potential configurations of the projectile (due at least to the fact that the batteries occupy a substantial amount of space within the projectile). Furthermore, batteries are relatively expensive, thereby driving up the cost of manufacture of such a projectile. Furthermore, and quite concerningly, batteries drain and lose charge over time, which means that a projectile so configured may not be in a usable state for firing if it has been on the shelf for a length of time. This drawback is not acceptable, as the conditions under which such projectiles are to be used requires that they be ready to fire at all times. Furthermore, such a projectile may require a blasting cap or primer to fire it out of a launcher, therefore requiring a hammer and a more complex launcher for operation.

All of the currently available methods suffer from one or more of the following disadvantages: difficult to target, not suitable for close range, not suitable for long range, inaccurate, sometimes lethal and often otherwise not effective, costly to manufacture, complex in configuration, and not reliably powered.

SUMMARY OF THE DISCLOSURE

In view of the foregoing disadvantages inherent in the prior art, the general purpose of the present disclosure is to provide a projectile construction (also referred to herein as "projectile" in context) and projectile launcher that include all the advantages of the prior art, and overcomes the drawbacks inherent therein. As used herein, it is understood that the debilitating material can be in powder, liquid or aerosol form without departing from the spirit of the disclosure. The projectile also preferably comprises an energy storage means. As used herein, "energy storage means" is a storage means that lacks a sufficient charge to activate or arm the projectile or another component of the projectile until the energy storage means has been charged or energized by an outside source (such as a launcher)). The minimum charge energy to activate or arm the projectile (or to imitate a reaction as described elsewhere herein) is referred to as the "threshold energy", meaning that at energy levels below the threshold energy, the projectile will not be armed or activated and/or cannot initiate a mechanical or chemical reaction. In an embodiment, the energy storage means comprises a capacitor, which capacitor may be charged by the launcher prior to launching of the projectile.

In an embodiment, a launcher comprises at least one interference point, such as pins, needles, sharp edges or other similar protrusions that may be disposed in the barrel of the launcher, proximate to the point of projectile exit, which at least one interference point may cause an opening in the projectile. (See FIG. 1A, for example). In an embodiment, the position of at least one interference point can be adjusted by the user (either axially or radially with respect to the barrel, for example). In a non-limiting embodiment the projectile comprises one of PAVA, Capsaicin, Dihydrocapsaicin (DHC), Nordihydrocapsaicin (NDHC), or other capsaicinoid derived debilitating powder that may be released in proximity of a target. Typically, this embodiment might be used in close range conditions such as within a structure.

In an embodiment, the projectile separates into two or more components after it leaves the barrel of a launcher to distribute a cloud of debilitating material such as in the form of powder or an aerosol of droplets or a combination thereof. In an embodiment, the separation can be initiated by electrical, mechanical or chemical means or by a combination thereof. In a still further embodiment, the initiation can be varied depending on the distance to the suspect or target.

In another embodiment the projectile includes a high drag and a low drag area in which the high drag area pulls and opens a cavity which allows for dispersal of the debilitating material. In certain embodiments these high drag areas can be part of a cartridge in the projectile and may be activated once the cartridge and projectile leave the barrel of the launcher. In another embodiment, the high drag area can separate and be tethered to the projectile, allowing designation of the distance at which point a shell of the projectile is ruptured and the powder dispersed.

In another embodiment, the projectile includes a mechanical release, such as in the form of a spring, for example, which allows portions of the projectile to separate from one another after the projectile has left the barrel.

In another embodiment the projectiles include various means of adjustment of the aforementioned embodiments in which the release or dispersion of the debilitating material occurs at fixed or predetermined distances from the barrel of the launcher. For example, selective release can be accomplished by a timed reaction or a tethering mechanism in which the tether length is adjusted to provide for varying distances before at least one portion of the projectile shell is ruptured to allow the contents to disperse.

In another embodiment, the projectile has at least one fin that causes rotation of the projectile and improves the dispersion of the debilitating material.

In yet another embodiment, the projectile has a capture pin in which components of the projectile are allowed to separate after release from the launcher but remain tethered for at least a portion of the flight. This may result in a more controlled release of the debilitating material.

In another embodiment, the projectile comprises a reaction that is initiated by the sudden acceleration of the launch of the projectile. This reaction may cause an outer membrane of the projectile (that contains the debilitating material) to fracture either as a result of a chemical or mechanical reaction or pressure or combination thereof.

In still another embodiment there are at least two parts to the projectile with fins on each part causing a counter rotation (with respect to each part) during flight. This allows parts which may have a threaded connection between the parts to unscrew thus allowing distribution of the debilitating material.

In yet another embodiment, the projectile has two pieces that may be acted upon by air pressure caused by the velocity of the launched projectile, which air pressure may exert a force on one of the two pieces to provide for separation of the pieces and thus a release of the debilitating material at some distance away from an operator of the launcher.

In a still further embodiment, the debilitating material is kept at a safe concentration within the projectile. Such concentration can be in the range of less than 30% and, more desirably, less than 15%. The resulting cloud of debilitating material is designed to be an effective dose (and in an embodiment, approximately 5 to 20 ppm). For example, with a projectile having a 10% concentration of powder at 1 g/cc and 3 cc total volume, the amount of active agent is 0.3 g, which may generate a 0.06 $m^3$ envelope at 5 ppm concentration. This is roughly equivalent to a 0.5 meter diameter sphere.

In another embodiment, an electrical circuit may be contained within the projectile. The electrical circuit may either initiate a chemical reaction or otherwise cause a separation of the projectile through an electromechanical method. Such methods can include an electromagnet, shape memory alloy or the like. The release may be timed such that the separation is in proximity of the target. The timing may include calculations based on the projectile velocity as well as the distance to the target. The electrical circuit and reaction can be initiated when the energy storage means has been sufficiently charged, i.e., beyond the threshold energy—such charging being done by the launcher or outside source, for example.

In a still further embodiment to a projectile containing an electrical component, the electrical circuit may be activated by the launcher. Such means of activating can include direct electrical connection, inductive charging or the like. By limiting activation to the launcher, it is possible to encode the projectile and improve the safety characteristics by reducing the likelihood of an accidental release of the projectile powder.

In a still further embodiment, the electrical circuit can be activated by a motion sensing switch such as an accelerometer, vibration sensor, or the like at launch of the projectile.

In a still further embodiment in which the separation is a result of a chemical reaction, an activating compound such as nitrocellulose or $NaN_3$ may be initiated with an "electric match". The electric match may consist of a nichrome or similar high resistance wire that is coated with a pyrogen and is initiated with electrical energy such as from a battery, capacitor, or the like.

In another embodiment the separation or opening of the projectile is caused by the force of the launch upon the projectile.

In a still further embodiment, the projectile launcher and the projectile are part of a system in which the projectile is encoded with timing and or distance information as a result of range to target. The projectile launcher may further include a range finder or other means for measuring distance to a target. The launcher and projectile can be configured to be in wired or wireless communication with each other. The launch of the projectile by the launcher can be accomplished by compressed air, thus eliminating the requirement for complex firing mechanism (such as a primer on the projectile or a hammer for the launcher).

DESCRIPTION OF THE DRAWINGS

The advantages and features of the present disclosure will become better understood with reference to the following detailed description and claims taken in conjunction with the accompanying drawings, wherein like elements are identified with like symbols, and in which:

DETAILED DESCRIPTION OF THE DISCLOSURE

The exemplary embodiments described herein detail for illustrative purposes are subject to many variations in structure and design. It should be emphasized, however, that the present disclosure is not limited to a particular projectile or projectile launcher as shown and described. That is, it is understood that various omissions and substitutions of equivalents are contemplated as circumstances may suggest or render expedient, but these are intended to cover the application or implementation without departing from the spirit or scope of the claims of the present disclosure. The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present disclosure provides for a nonlethal projectile 100 and a launcher 1000 for such a projectile 100, the launcher 1000 and projectile 100 comprising a system. The projectile 100 preferably comprises a debilitating material 200 (such as capsaicin, PAVA, tear gas, etc.) for immobilizing a target or suspect. The projectile 100 preferably comprises an enclosure, which enclosure may be formed by an at least partially annular-shaped shell 102. The shell may include a closed, substantially planar end portion 104 (also referred to herein as "end cap") that corresponds to a radius of the annular portion of the shell to form the enclosure. The shell and end portion may individually and collectively referred to herein as a housing of projectile 100. The debilitating material 200 is preferably contained in the enclosure prior to launch of the projectile 100. In an embodiment, the projectile 100 is capable of self-separating, disintegrating or otherwise opening prior to impact with a target. In an embodiment, the launcher 1000 is capable of initiating separation or disintegration or rupturing or opening, etc. of the projectile 100. In an embodiment, the launcher 1000 is capable of communicating to the projectile 100 and or arming a projectile 100 prior to or coincident with projectile launch. In another embodiment, the launcher comprises a safety and/or trigger, which safety and/or trigger, until activated, prevent the projectile from becoming armed. The arming can be, for example, the charging of an energy storage element or means contained within the projectile.

Figure 10:
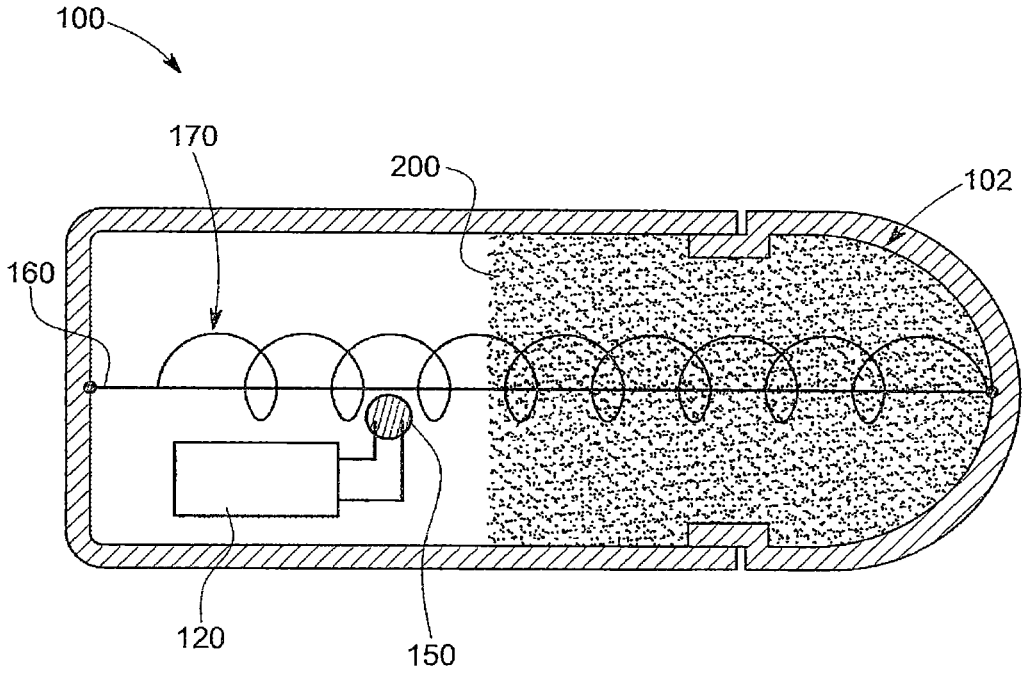
FIG. 10 is shows a projectile with a housing, a compression element, a tether element, and an initiator and control circuit, in accordance with an exemplary embodiment of the present disclosure.

The planar end portion 104 of the projectile 100 is preferably removably attachable to the annular portion of the shell 102. The attachability of the planar end 104 to the annular portion may be a press fit, threaded connection, or via adhesive or other bond, for example. The attachability allows for ease of access to the enclosure formed by the planar end portion 104 and annular portion of the shell 102. The planar end portion 104 of the shell may have a greater dimension than the diameter of the annular portion of the shell 102 against which it attaches to create a flange. In another embodiment, the shell 102 comprises a first annular portion and a second annular portion in which the planar end portion 104 is fixedly attached to said first annular portion and in which the first annular portion and second annular portion are removably attached to one another such that the enclosure of the shell 102 may be opened elsewhere than the planar end portion 104 of the shell (such as shown in FIG. 10, for example).

Figure 1:
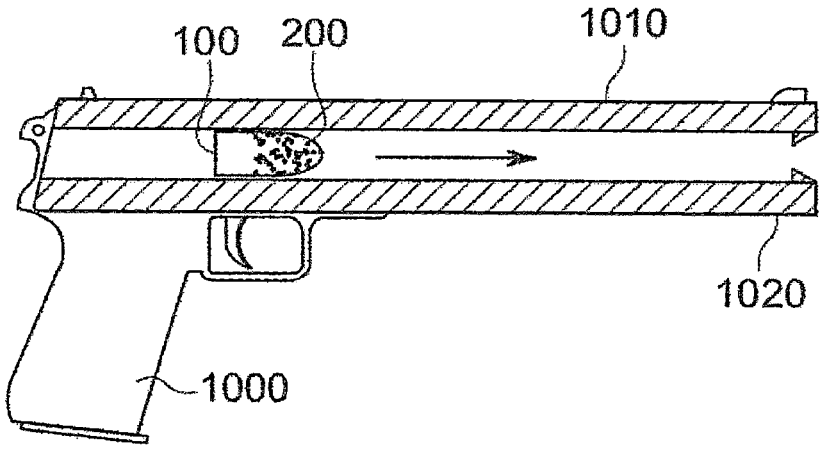
FIG. 1 is a longitudinal cross-sectional view of a projectile launcher 1000 with a projectile, according to an exemplary embodiment of the present disclosure.
Figure 1A:
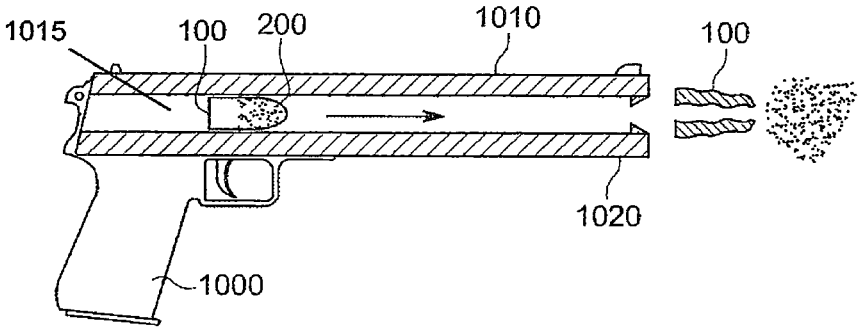
FIG. 1A is a view of the barrel of a projectile launcher showing fins or other means for causing an opening in the projectile as it moves down the barrel, in accordance with an exemplary embodiment of the present disclosure.
Figure 2:
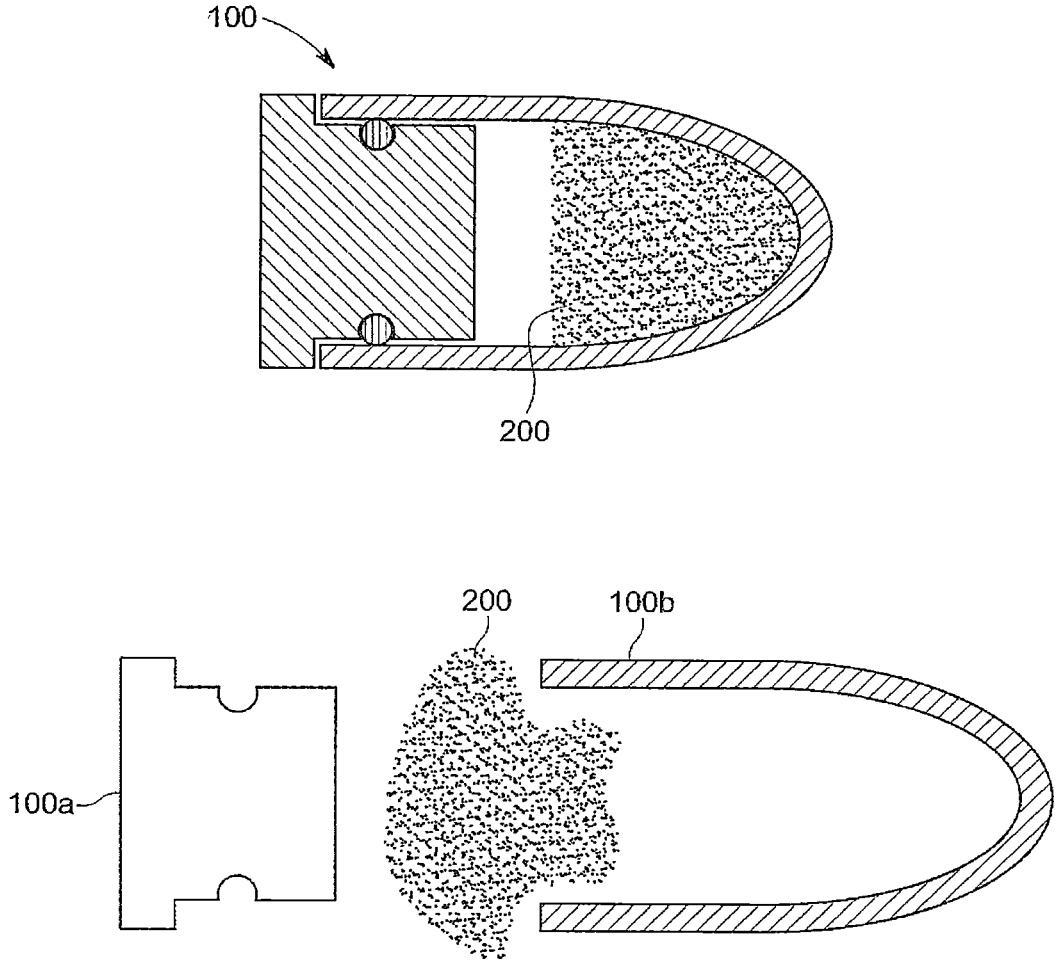
FIG. 2 are views of a projectile both before launch and then during flight in which the housing of the projectile has separated and released a debilitating material, in accordance with an exemplary embodiment of the present disclosure.

An exemplary launcher 1000 is shown in FIG. 1A. The launcher comprises a barrel 1010 for directing and launching a projectile 100. The launcher 1000 may also comprise a chamber 1015 for holding a projectile prior to firing thereof. It will be apparent that the launcher 1000 shown in FIG. 1*a* may be in other configurations so long as the launcher 1000 is capable of firing a projectile 100 of the projectiles disclosed herein. In an embodiment, the projectile launcher has pins, needles, sharp edges or other similar protrusions 1020 predisposed in the barrel proximate to the point of projectile exit, which protrusions 1020 may initiate an opening in the projectile housing. In another embodiment the position (either axially or radially, for example) of the edges of the barrel 1010 of the launcher 1000 that weaken or puncture the projectile 100 at or near the exit of the projectile launcher 1000 can be adjusted by the user. In an embodiment the projectile 100 comprises one of PAVA, capsaicin or other debilitating material 200 (preferably in powder form) that may be released in proximity of a target, for example.

In an embodiment, the projectile 100 housing opens or otherwise separates after it leaves the barrel 1010 of a launcher 1000 to distribute a cloud of debilitating material 200, such as in the form of powder or an aerosol of droplets or a combination thereof. That is, the rupturing or breaching of the projectile housing or the separation of housing components creates an opening in the projectile 100 out of which the debilitating material 200 may emanate.

In another embodiment the projectile 100 includes a high drag and a low drag area in which the high drag area pulls and opens a cavity which allows for dispersal of the debilitating material 200. In an embodiment such high drag areas can be part of a cartridge and may be activated once the projectile leaves the barrel 1010 of the launcher 1000. In another embodiment, the high drag area can separate and be tethered to the projectile, to improve dispersion of the debilitating material 200.

In another embodiment, the projectile 100 includes a mechanical release in the form of a spring or elastomer, for example, which allows distinct portions of the projectile to separate after the projectile 100 has left the barrel of the launcher. The mechanical release may be triggered by acceleration or a particular velocity of the projectile, or by air pressure exerted on the projectile after launch, for example.

Figure 12:
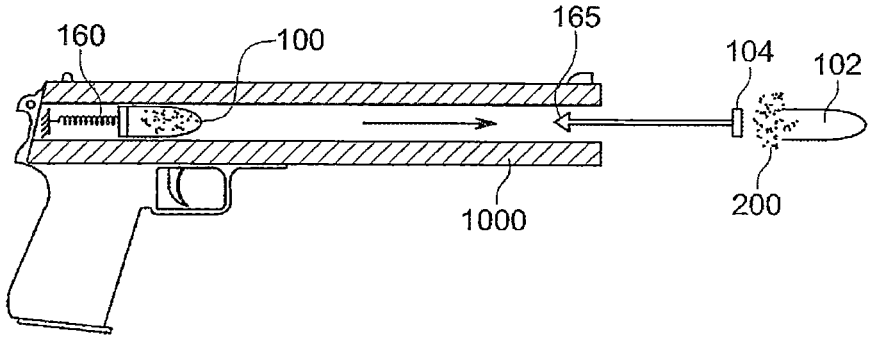
FIG. 12 shows a launcher, projectile, and tether, in accordance with an exemplary embodiment of the present disclosure.

In another embodiment the projectiles 100 disclosed herein include various means of adjustment of the aforementioned embodiments in which the release or dispersion of the debilitating material 200 occurs at fixed or predetermined distances from the barrel 1010 of the launcher 1000. For example, selective release can be accomplished by a timed reaction or a tethering mechanism 165 (the latter of which being shown in FIG. 12, for example, as a pull-weight near or at the end of the projectile that is proximate to the launcher after launch) in which the tether length is adjusted to provide for varying distances before at least one portion of the projectile shell is moved (whereby an opening in the projectile is created) to allow the contents to disperse.

Figure 3:
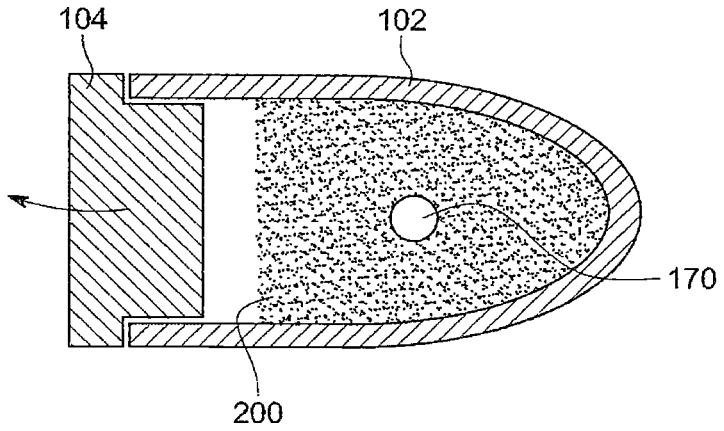
FIG. 3 is a view of a projectile that has a component which can increase the pressure inside the housing of the projectile based on a predetermined time, in accordance with an exemplary embodiment of the present disclosure.
Figure 5:
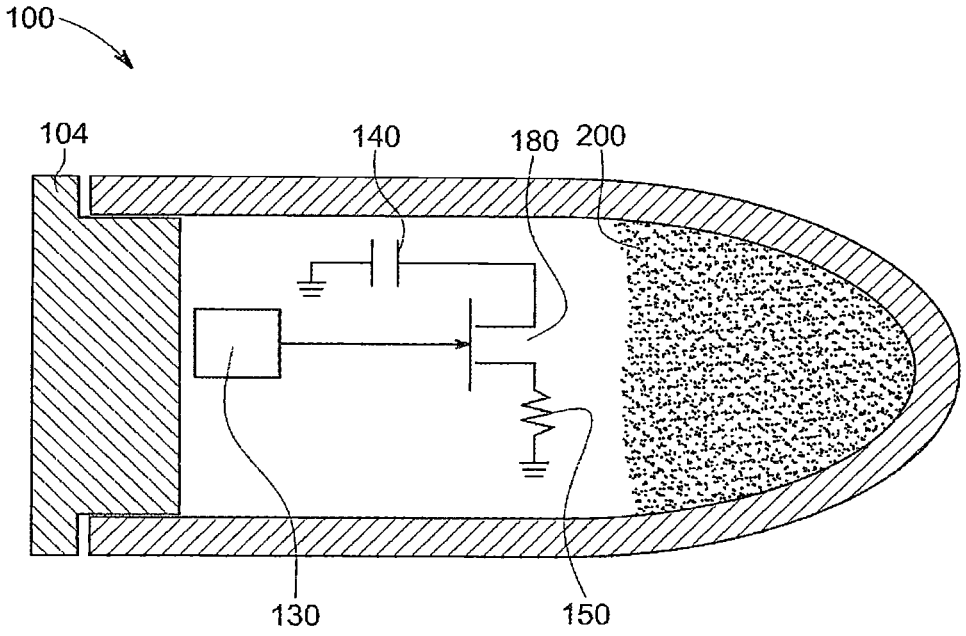
FIG. 5 is a view of a projectile comprising a debilitating material, a control circuit, an initiator, and an energy storage means, in accordance with an exemplary embodiment of the present disclosure.

In another embodiment, the release may be accomplished by a control circuit 120. Such a control circuit 120 may include a radio-frequency identification (RFID), where an RFID tag in the projectile 100 may cause the projectile 100 to rupture at a user-specified distance from the launcher 1000. In another embodiment as shown in FIGS. 3 and 5, a reaction may be initiated in response to a timer 130. Such reaction may increase the pressure inside the projectile 100 (as shown by an airbag 170 in FIG. 3 for example) or otherwise cause a breach in the projectile housing. Furthermore such component may be initiated by a reaction and comprise materials such as nitrocellulose, $NaN_3$ or the like. In such an embodiment, it will be apparent that the launcher 1000 may comprise a transmitter or other means for communicating with the RFID tag or the reaction may be controlled by other means.

Figure 4:
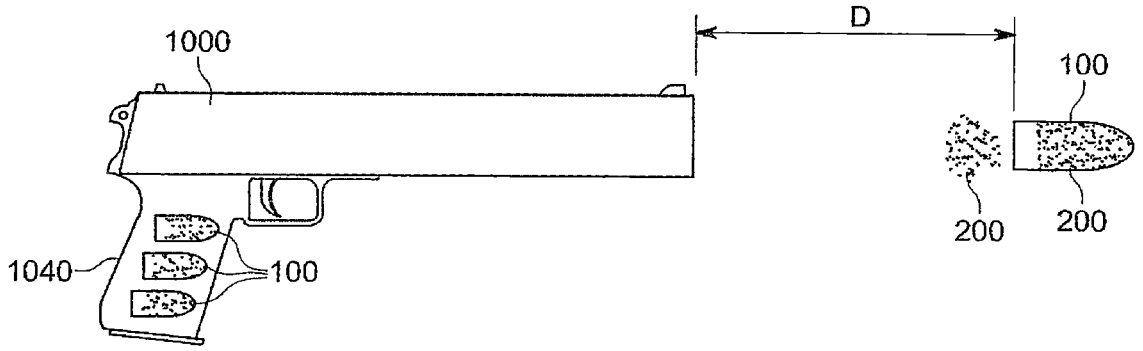
FIG. 4 is a view of a projectile launcher with a magazine in which the projectiles are set to rupture at various times/distances after launch, in accordance with an exemplary embodiment of the present disclosure.

As shown in FIG. 4, the launcher and projectile system may comprise a magazine 1040 that holds a plurality of projectiles 100 and that feeds said projectiles 100 to the launcher 1000 for firing/launching the projectiles 100. In an embodiment, the various projectiles 100 of the magazine 1040 may be configured to separate or rupture, etc. at the same distance "D" or time after launch, or they may be configured to separate or rupture, etc. at different distances and/or times after launch. In the embodiment where the various projectiles are configured to separate or rupture, etc. at the same distance "D" or time after launch, it will be apparent that a user may concentrate the effect of the debilitating material from the ruptured projectiles within a certain defined area. In an embodiment where the various projectiles are configured to separate or rupture, etc. at different distances and/or time after launch, it will be apparent that (1) the particular distance and/or time after launch at which the separation, etc. of each particular projectile of the various projectiles may be accomplished by selectively setting the separation, etc. of each projectile of the various projectiles as elsewhere set forth herein. Further, the separation, etc. of the various projectiles at different distances may provide for a more distributed dispersion of the debilitating material in the event that dispersion of such material over a greater area is desired.

In another embodiment, the projectile has fins that cause rotation of the projectile and improve flight and/or dispersion of the debilitating material.

Referring again to FIG. 5, the projectile 100 may further comprise an energy storage means 140 (such as, but not limited to, a capacitor or a miniature Lithium ion rechargeable battery) and an initiator 150 (such as, but not limited to, a heating element). As used herein, "energy storage means" is a storage means that lacks a sufficient charge to activate or arm the projectile or another component of the projectile until the energy storage means has been charged or energized by an outside source (such as a launcher, said launcher comprising an electrical source)) beyond a threshold energy. The charging of the energy storage means may also be referred to herein as "energizing" the energy storage means. The energy storage means disclosed herein may also be referred to as an energizable energy storage means. The energy storage means 140 and initiator 150 may be operatively coupled to a switch 180, and the timer 130 may cause the switch 180 to trip at a particular time after launch of the projectile 100, after which the energy storage means 140 may deliver stored energy to the initiator 150 to cause the initiator 150 to perform a reaction (such as heating) that results in the projectile 100 opening, separating or disintegrating to release the debilitating material 200.

Figure 6:
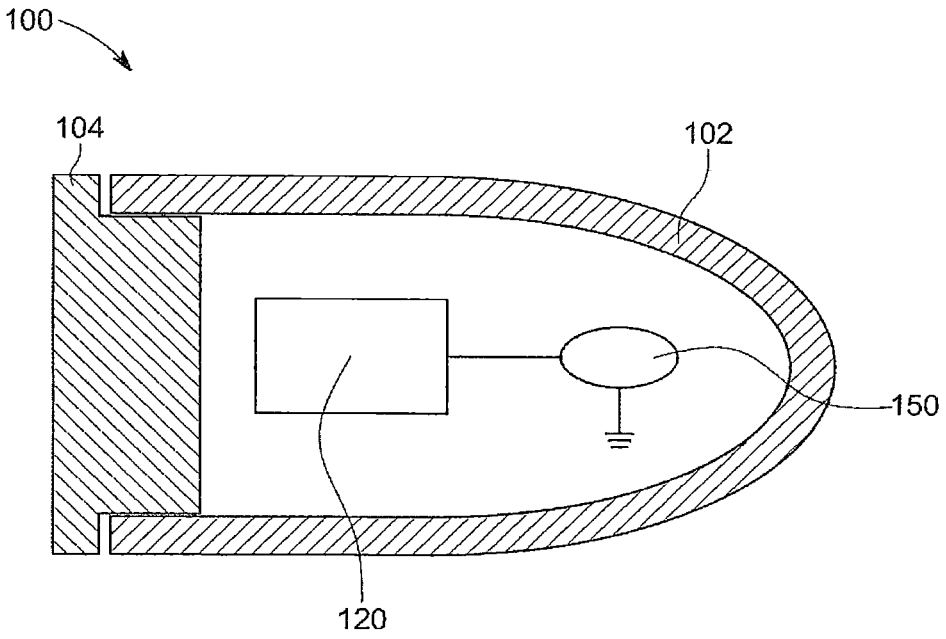
FIG. 6 is a view of a projectile comprising a debilitating material, an initiator, and a control circuit, in accordance with an exemplary embodiment of the present disclosure.

In another embodiment, and referring to FIG. 6, the control circuit 120 is directly coupled to the initiator 150 such that the control circuit 120 activates the initiator 150. As shown in FIG. 6, the initiator 150 may be an electric match, which electric match may heat upon activation to create an opening in the shell of the projectile 100 to release the debilitating material 200.

Figure 7:
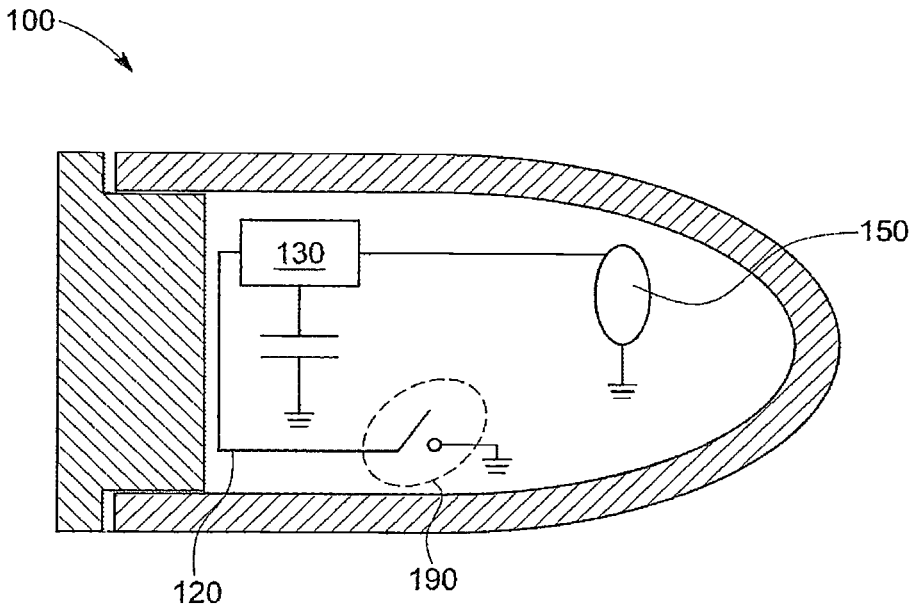
FIG. 7 shows a projectile containing a debilitating material, a control circuit, an initiator and a switch that may triggered by acceleration or force exerted on the projectile during launch of the projectile, in accordance with an exemplary embodiment of the present-disclosure.
Figure 7A:
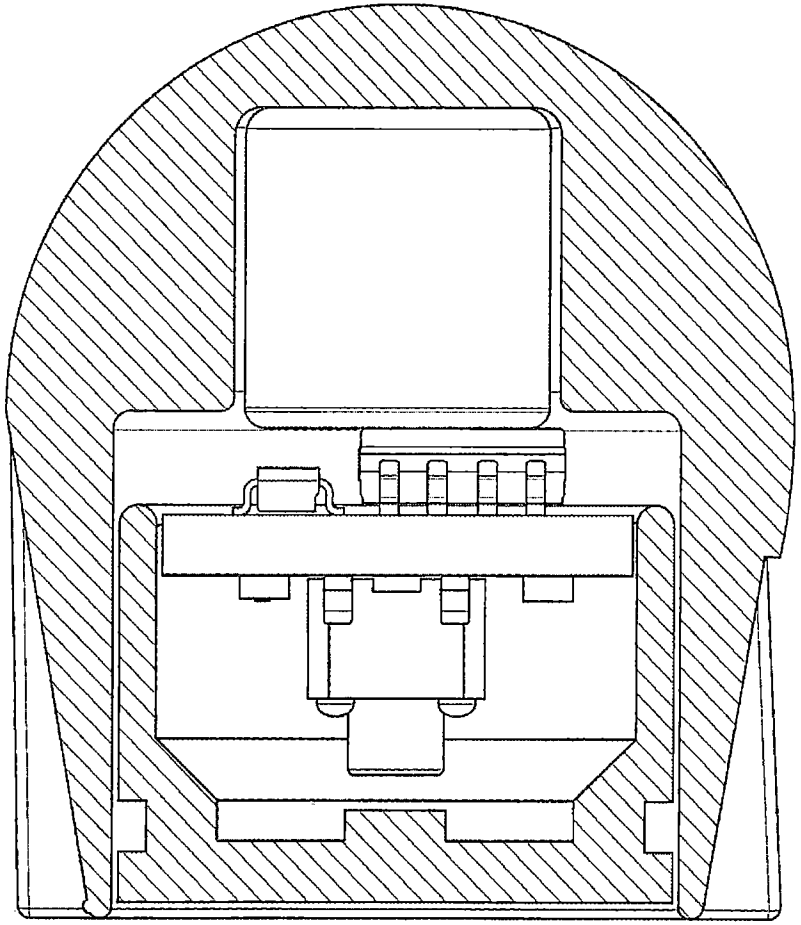
FIGS. 7A and 7B show a projectile with a control circuit and timer that are activated by the force of the launch of the projectile, in accordance with an exemplary embodiment of the present disclosure.
Figure 7B:
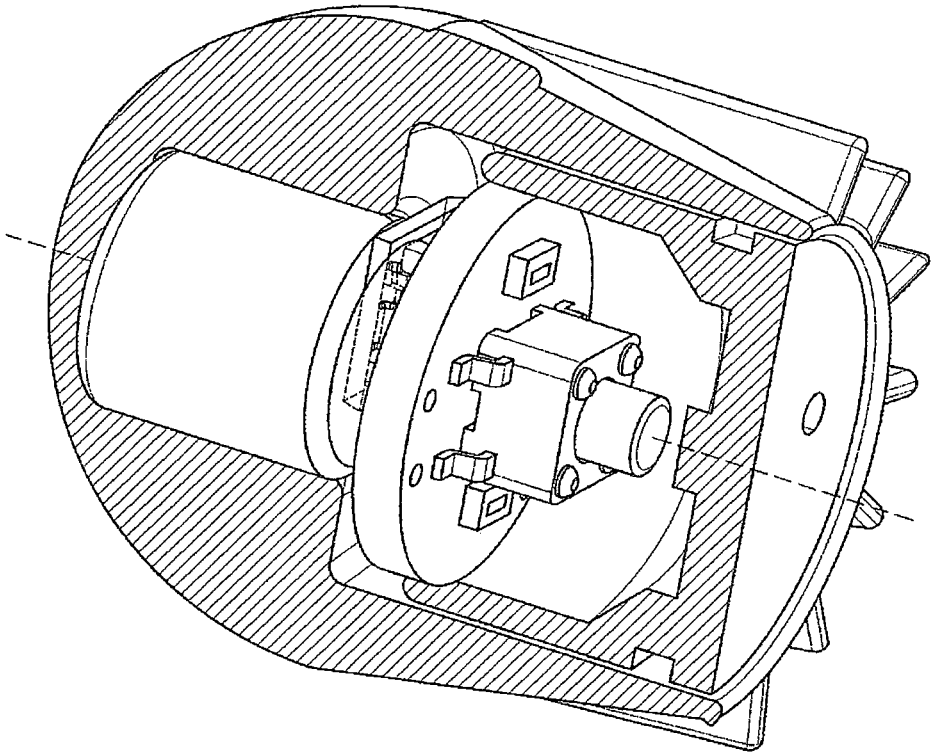

In another embodiment and as shown in FIGS. 7, 7A and 7B, the projectile control circuit 120 and/or timer 130 may be activated in response to the sudden acceleration or force that occurs upon the launch of the projectile 100, such as by a switch or an accelerometer 190. The control circuit 120 and/or timer 130 may then activate an initiator 150 which triggers a breach in the projectile housing, allowing for dispersal of the debilitating material 200. This breach may be a result of internal pressure buildup, component separation, or melting a section of the housing.

Referring to FIGS. 7A and 7B, a projectile 100 with a control circuit 120 and timer 130 that are activated by the force of the launch of the projectile 100. In an embodiment, the projectile 100 comprises a button 195. Upon launch of the projectile 100, the end cap 104 presses or otherwise engages the button 195. The button 195 is operatively coupled to the timer 130 such that, upon the pressing of the button, the timer 130 is started. After a period of time measured by the timer 130, the capacitor 140 discharges into an initiator, and the initiator performs a reaction (such as heating and such as elsewhere described herein) that results in the projectile 100 opening, separating or disintegrating to release the debilitating material 200. In another embodiment, the force of launch can be stored after launch (in a spring for example) to be released further thereafter to activate the opening of the projectile and/or release of the debilitating material from the projectile.

In another embodiment, the projectile launcher 1000 comprises a trigger and/or a safety switch, which trigger and/or switch prevent the projectile 100 from becoming armed until a certain parameter is met. For instance, the safety may be configured to prevent the projectile 100 from becoming armed unless it is turned to fire mode in the launcher 1000. In another embodiment, the energy storage means is in communication with trigger or safety switch and is not energized until after the trigger or safety switch is actuated. Such trigger and safety switch can thereby prevent accidental firing or rupturing of a projectile in the event that the launcher is forcibly but unexpectedly moved, or if the user accidentally drops the launcher, for example.

Figure 8:
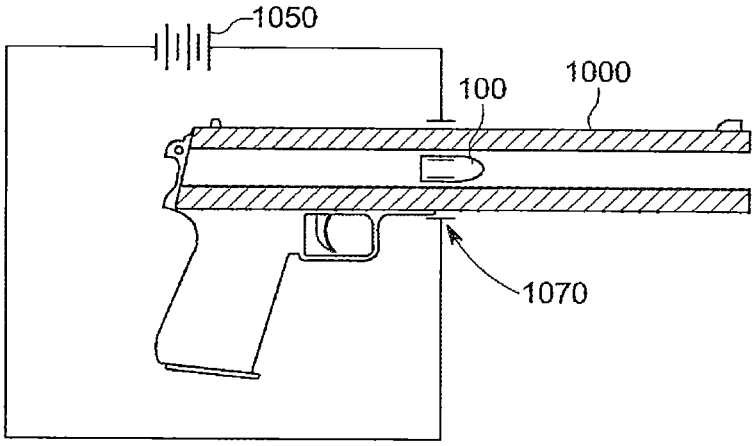
FIG. 8 shows a projectile and launcher in which the launcher may communicate to the projectile through at least one connection, in accordance with an exemplary embodiment of the present disclosure.
Figure 9:
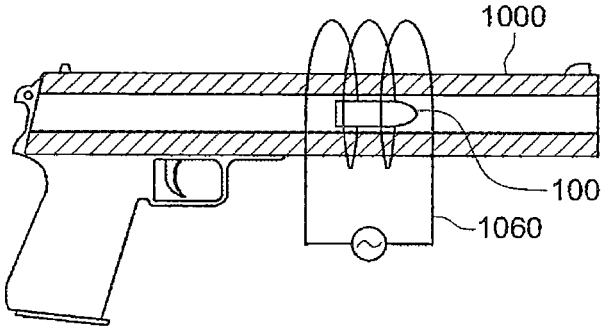
FIG. 9 shows a projectile and a launcher in which the projectile may communicate wirelessly with the launcher, in accordance with an exemplary embodiment of the present disclosure.
Figure 11:
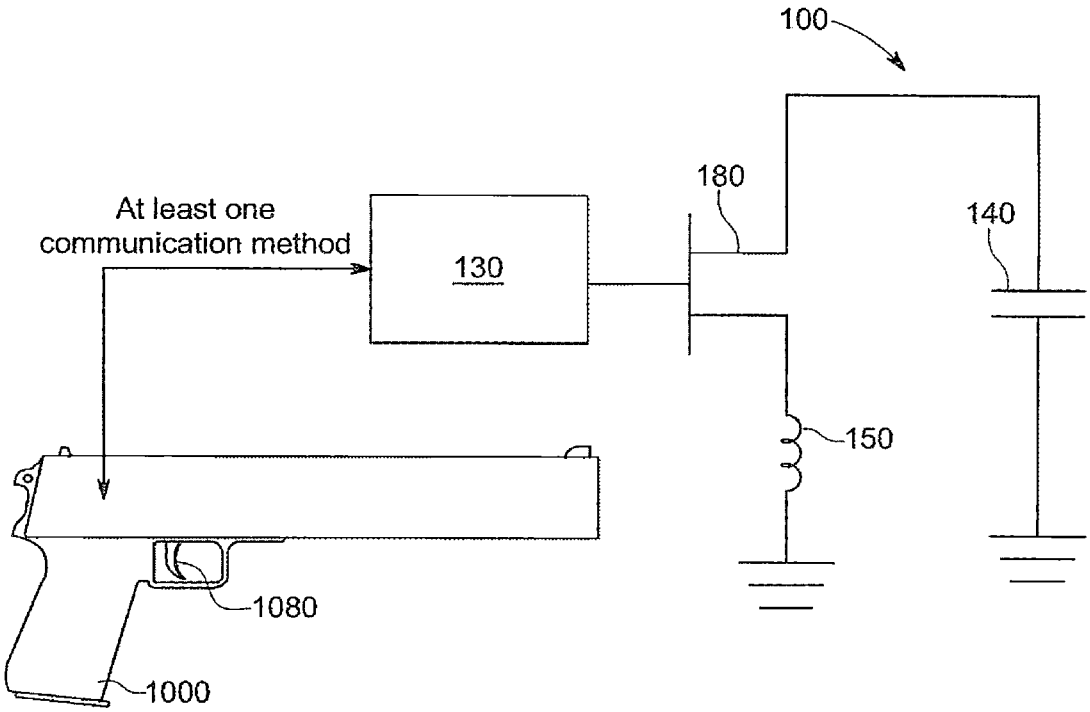
FIG. 11 shows a launcher, components of a projectile and at least one means of communicating information to the projectile, in accordance with an exemplary embodiment of the present disclosure.

In still another embodiment as shown in FIGS. 8, 9 and 11 the projectile 100 and the launcher 1000 communicate through at least one of a wireless or wired means. This allows the launcher to set parameters within the projectile allowing for more precise control of the point at which the housing is breached or ruptured, i.e. to set a particular distance or time at which the projectile may rupture. In a still further embodiment, the projectile has an energy source (such as an energy storage means 140) which is activated or powered or energized by the launcher 1000 (for example, by means of a battery 1050 in the launcher that the projectile 100 may come into contact with when loaded in the launcher 1000, at a contact point 1070 as shown in FIG. 8) and thus enhances the safety profile of the projectile 100, e.g., by keeping the projectile 100 and dispersal means inactive until it is chambered in the launcher. In another embodiment, as shown in FIG. 9, the projectile (and, in an embodiment, the energy storage means 140 thereof) can be charged or energized via induction, such as via an inductive charger 1060. In a still further embodiment, the launcher 1000 includes a means for measuring distance, such as a range-finder, which means may communicate with the control circuit 120 and which means may permit in-situ customization of at least one parameter related to the burst or breach of the projectile 100, thus further increasing its ability to disperse the debilitating material 200 at a more preferred or precise location. As shown in FIG. 11, the launcher 1000 may comprise a trigger 1080 to initiate the launch process. It will be apparent that the charging of the energy storage means by the launcher eliminates the requirement that the energy storage means comprise a self-contained power source (i.e., a battery for the energy storage means is not required), thereby eliminating the possibility that the energy storage means will suffer a power drain prior to launch. It will be apparent that the energy storage means can also be charged by an outside source other than the launcher prior to loading in the launcher. Further, a capacitor as an exemplary storage means is significantly lighter and cheaper than a battery, thereby improving performance and reducing the cost of manufacture of the present projectile.

In another embodiment, and as shown in FIG. 10, the projectile includes one of a control circuit 120, debilitating material 200, a housing, an initiator 150, an internal tether 160, and a compression element 170. The advantage of this construction is that the dispersal of the debilitating material 200 would be a result of the initiator 150 allowing the tether 160 to release or sever, thus allowing a breach in the housing of the projectile.

Figure 13:
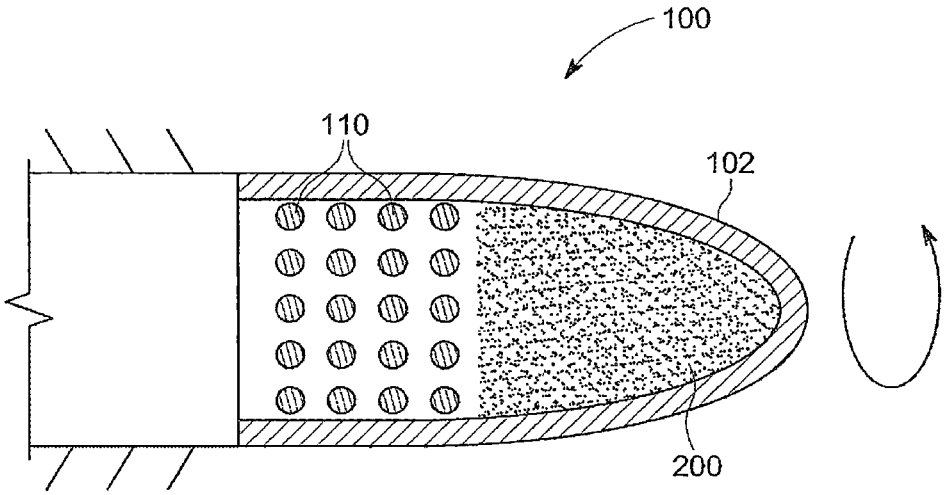
FIG. 13 shows a projectile comprising pores through which debilitating materials may be dispersed, in accordance with an exemplary embodiment of the present disclosure.

In yet another embodiment and referring to FIG. 13, the projectile 100 comprise at least one pore 110 and preferably, a plurality of pores 110, disposed in and/or on the annular portion of the shell 102. The pores preferably comprise a material that is less resilient than the shell 102 and that is or becomes permeable such that the debilitating material 200 within the projectile 100 may be released through the pores into the environment. In an embodiment, the projectile may rotate while in flight (through rifling in the barrel 1010 of the launcher 1000), and the centripetal force created by such rotation may force the debilitating material out of the projectile 100 through the pores. In another embodiment, the debilitating material 200 may be contained in a sphere or other shaped-container within the projectile 100 prior to launch, and the sphere or other container may thereafter be pierced or ruptured (such as with a pin that is also inside the projectile 100) thereafter to allow the debilitating material 200 to be positioned for release out of the projectile 100.

In a still further embodiment, the debilitating material 200 is kept at a safe concentration within the projectile 100. Such concentration can be in the range of less than 50% and, more desirably, less than 15%. The resulting cloud of debilitating material 200 is designed to be an effective dose (and in an embodiment, approximately 5 to 20 ppm). For example, with a projectile 100 having a 10% concentration of powder at 1 g/cc and 3 cc total volume, the amount of active agent is 0.3 g which may generate a 0.06 $m^3$ envelope at 5 ppm concentration. This is roughly equivalent to a 0.5 meter diameter sphere of dispersal of the debilitating material 200.

FIG. 1 represents a projectile launcher 1000 that is preferably based on electrical-driven or a combination of electrical and combustion or compressed gas means. It is understood that the projectile is not limited to a particular launching method but a preferable designed-launcher in which the advantages of having an electronic control and communication element with the projectile can be used. The projectile herein being of lightweight construction (for at least the reason that it does not require an internal battery), compressed gas can sufficiently and effectively launch the projectile (that is, a primer and/or blasting cap on the projectile and a hammer of the launcher to strike such primer are not required by this disclosure). Because the projectile is chargeable by the launcher or other outside source, the possibility that the projectile would fail to operate due to draining of an internal battery is rendered moot.

The projectile and launcher disclosed herein offer the advantages of more controlled release of debilitating material than existing solutions can offer. For instance, a user can set the range and/or rate at which the material is released by configuring parameters that control the opening in the projectile. The projectile also avoids the use of explosives and/or accelerants to achieve dispersal and further does not require impact upon a target (therefore reducing the risk of injury to a target) to disperse the debilitating material. Configuration of the shell of the projectile disclosed herein may also increase accuracy of flight of the projectile to further improve the safety of use of the projectile disclosed herein. Furthermore, the projectile can be kept in an unarmed state until the energy storage means is sufficiently charged, i.e., beyond a threshold energy. The charging of the energy storage means by the launcher or other outside source eliminates the possibility that the projectile will suffer from power loss or failure prior to firing.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. A launcher and projectile system, the system comprising a launcher, a projectile, said projectile comprising a debilitating material contained within at least a portion of said projectile and a capture pin, and a tether, said tether having a length dimension and said tether operatively coupled to said launcher and said projectile, wherein after said projectile is launched, said projectile travels a distance equal to the length of the tether, and upon reaching said distance, an opening is facilitated in the projectile, the opening allowing the debilitating material to be released from the projectile, and wherein said capture pin causes said projectile to remain coupled to said tether after said opening is facilitated in said projectile.

* * * * *